US006986625B2

(12) United States Patent
Witheridge

(10) Patent No.: US 6,986,625 B2
(45) Date of Patent: Jan. 17, 2006

(54) MAINTAINING FLUIDIZED BEDS OF COHESIVE PARTICLES USING VIBRATING FLUIDS

(76) Inventor: Anthony John Witheridge, 330 N. Jefferson St., Batavia, IL (US) 60510

( * ) Notice: Subject to any disclaimer, the term of this patent is extended or adjusted under 35 U.S.C. 154(b) by 82 days.

(21) Appl. No.: 10/818,562

(22) Filed: Apr. 6, 2004

(65) Prior Publication Data

US 2004/0247401 A1 Dec. 9, 2004

Related U.S. Application Data

(63) Continuation-in-part of application No. 10/418,611, filed on Apr. 21, 2003, now abandoned.

(51) Int. Cl.
*B65G 53/66* (2006.01)

(52) U.S. Cl. ..... 406/85; 406/90; 406/138

(58) Field of Classification Search ..... 366/3, 366/4, 5, 10, 106, 107; 406/136, 137, 89, 406/90, 91, 138, 197, 85
See application file for complete search history.

(56) References Cited

U.S. PATENT DOCUMENTS 2,171,398 A * 8/1939 Edouard ..... 366/106
2,844,361 A 7/1958 Dilcher et al.
3,148,865 A * 9/1964 McClellan ..... 366/106
3,519,310 A 7/1970 Holm et al.
3,544,074 A * 12/1970 Noi et al. ..... 366/106
3,608,866 A * 9/1971 Karpacheva et al. ..... 366/106
3,653,639 A * 4/1972 Mueller ..... 366/106
3,758,162 A * 9/1973 Holm et al. ..... 406/85
4,118,074 A * 10/1978 Solt ..... 406/85
4,383,766 A * 5/1983 Eriksson ..... 366/106
4,439,072 A 3/1984 Goedken
4,697,960 A * 10/1987 Pelto et al. ..... 405/259.5
4,930,691 A * 6/1990 Nagell ..... 222/630
5,009,150 A * 4/1991 Andersen ..... 99/360
5,071,289 A * 12/1991 Spivak ..... 406/11
5,474,401 A * 12/1995 Paulsen et al. ..... 406/85
5,478,172 A * 12/1995 Oura et al. ..... 406/23
5,603,566 A * 2/1997 O'Ryan et al. ..... 366/107
6,302,573 B1 * 10/2001 Morimoto et al. ..... 366/106

* cited by examiner

*Primary Examiner*—Joe Dillon, Jr.

(57) ABSTRACT

This invention is a method for operating fluidized beds, such as used to convey powdered material, wherein the fluidizing gas flows are pulsed or vibrated to help initiate and maintain fluidization. The invention maintains the fluidization effects by preventing channeling or 'rat-holing' in a powder bed by oscillating gas pulse frequencies in the 0.5 to 300 hertz range. The invention further is directed to efficient conversion of the energy contained in the pressurized gas flow to vibrational energy. The invention describes devices capable of feeding one or more fluidized-beds from a compressed (pressurized) gas supply, thus conserving energy and increasing mass transfer within the beds.

22 Claims, 3 Drawing Sheets

FIG. 1
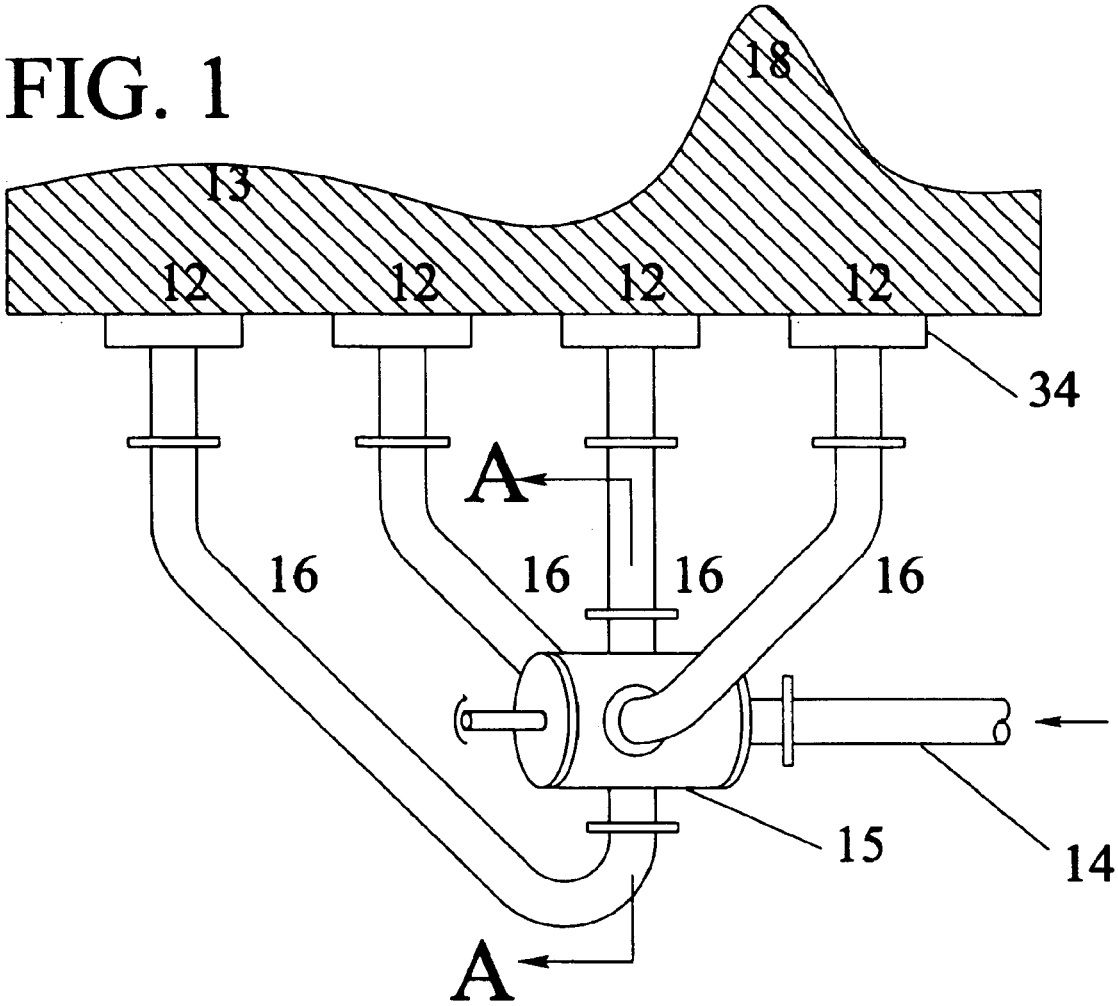
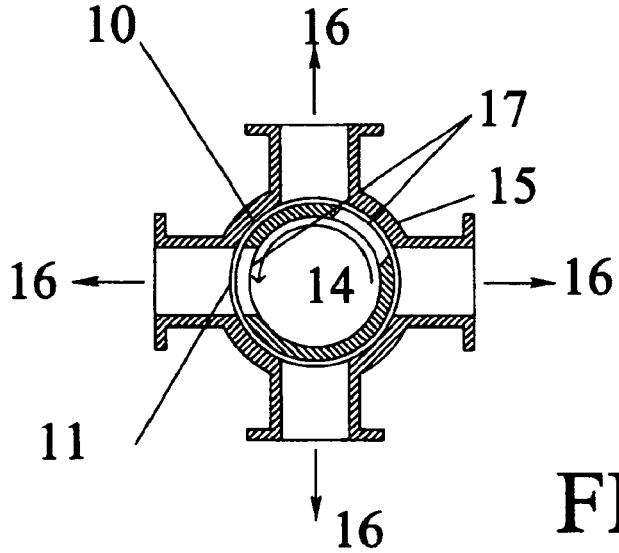
VIEW A-A
FIG. 2

MAINTAINING FLUIDIZED BEDS OF COHESIVE PARTICLES USING VIBRATING FLUIDS

CROSS-REFERENCE TO RELATED APPLICATIONS

This Application is a continuation-in-part of application Ser. No. 10/418,611 filed Apr. 21, 2003, now abandoned incorporated by reference herein.

BACKGROUND OF THE INVENTION

This invention relates to movement of powders and small particles that are capable of being suspended in a fluidized bed using a gas flow and more particularly relates to a method and apparatus useful in improving fluidized bed systems.

Many fine powders (such as cement, flour, and fly ash) are stored in large bulk containers for transport or later use, and these powders may be pneumatically transferred to or from ship hulls or bulk storage (often referred to as silos or bins). This pneumatic transferring includes "dense phase" or "dilute phase" processes, which nomenclature refers to the relative concentration of solids in the gas flow, and which may be suction or pressure induced. For example, dilute-phase pneumatic transfer is the technique used by a household vacuum cleaner to remove dust from a floor, and similar larger scale units are used to remove powders from silos that can be hundreds of feet in diameter.

Moving powders from within large silos to a point where they can be blown or suctioned off (i.e. pneumatically removed) is performed by various methods, including the use of mechanical scrapers or augers.

Another technique, which is the subject of this patent, is the use of an "air conveyor" or "air-slide" (illustrated in FIG. 3), wherein a porous surface or diffuser within the silo 31 has pressurized gas forced up through it, causing the finely divided materials in the proximity of the diffuser to be fluidized into 'fluidized bed.' This fluidized material flows along the surface of an "air slide" 34, which may be a fraction of a meter to hundreds of meters long, to a removal point or a drain 33 where the powder can be discharged from the silo, typically through a discharge pod 32, which concentrates the powder into a dense phase.

A fluidized bed of particles is formed by directing gas upward through the bed at a velocity sufficient to suspend the particles in the gas flow. This suspension occurs when the force of gravity (weight) on each particle is counter balanced by the drag-force of the rising gas, and the particles become a free moving mass of particles, which behaves much like a fluid. The minimum, constant, practical upward velocity of gas required to achieve and sustain this effect is referred to in this document as the "normal fluidization velocity."

Fluidized particulate beds are used in various applications. In one commercial application, fine particles, such as cement, flour, or fly ash, are stored in large domed containment vessels. A fluidized bed of such particles is induced in the domed structure to assist in transporting the particles though the bottom of such structure to another location such as a railcar or ship.

The fluidized bed effect, however, is not without complications. One complication is that some types of particles do not permit the gas to flow uniformly between the particles, leaving some regions of the bed un-fluidized. Sometimes this can be solved using higher gas flows, but this is energy inefficient and expensive and, in an open bed, may lead to particles being blown out of the bed. Alternatively, blasts of high-pressure gas can be induced through the gas feed system; however, in some systems, this is a short-term solution and induces fatigue and rupture of the fabric diffusers, which are typically used on the bottom of air-slides and fluidized bottoms of storage vessels. Examples of these techniques are described in U.S. Pat. Nos. 2,844,361 and 4,439,072, both incorporated by reference herein. Mechanical vibrators also have been used to decrease the tendency of particles to stick together or to the walls of the vessel (or other containers including a dome, silo, bin or tank), and these devices (for practical and maintenance reasons) typically are attached to the outside walls of the container. However, mechanical vibrators typically are not efficient at transferring that vibration energy throughout a large bed of particles, such as greater than ten tons (10,000 Kg) and when installed inside the fluidized-bed, have proven undesirable due to the constant maintenance issues. Examples of these can be found in British Patent Specification GB712,593 and U.S. Pat. No. 3,519,310, both incorporated by reference herein. These beds sometimes are very large may store up to hundreds of thousands of tons of material and may be in a fixed location or may be large compartments of ships or barges.

Bulk powder materials vary greatly in their ability to flow and their tendency to stick together; this can be a function of particle size distribution such as with coffee-sugar-crystals verses powdered-sugar, or a function of surface chemistry effects such as a smooth flowing Class "F" fly ash verses Class "C" fly ash (ASTM C618-00), the latter being comparatively cohesive (i.e. sticky). Most small particles will freely fluidize if they are initially separated, but cohesive particles may pack together when left standing for periods of time and resist being separated. This is the case with Class C Fly Ash for which bulk storage and recovery using air-slides has been problematic and subject to failure. The operation of silos associated with these air-slides can been frustrated by the inability to initiate the mechanism of fluidization. This is often caused when compressed gas channels to the surface and the finely divided materials becomes difficult or impossible to be completely extracted from a silo, thus leaving a large bulk of the material stuck in the silo and requiring expensive and sometimes dangerous mechanical removal. Another alternative may include the use of vibrators in the vicinity of the outlet or silo walls. Alternatively, introduction of electromechanically or pneumatically driven loudspeakers or horns have been used to induce a localized vibration to help the free flow of particles. However, these techniques are inefficient and generate relatively small amounts of vibration energy, therefore; they are limited to smaller containers such as rail-cars.

In a bulk materials transport system, particles may resist uniform movement of gas in a fluidized bed, and the gas finds a weak spot in the particle bed and creates a crack in the bed. Often, this is referred to as "channeling" or when describing only vertical escape of gas, it is referred to as "rat-holing." A bed with a "rat hole" viewed in cross-section resembles a cross-section of a volcano. Channeling often is a combination of vertical and horizontal cracks in the particle bed. Channeling allows a significant proportion of gas to escape to the surface of the particle bed with a minimum of energy, and denies the bulk of the bed the 'normal fluidization velocity' needed to fluidize it. Turning the gas flow off can collapse or otherwise disrupt the channeling, and when the gas flow is turned back on, the large gas voids typically rise to the surface. It is often difficult to determine the extent of channeling until the solids discharge stops.

The problem is that the air-slides may have been cleared in the vicinity of the powder outlet but not further away, and when this happens, the diffuser may become unevenly loaded with several inches (centimeters) at one end and heavily loaded with many feet (meters) of powder depth at the other end as illustrated in FIG. 5. FIG. 5 shows a bulk storage shed 78 with an inclined fluidized floor leading to an exit 75 with a depiction of an unevenly loaded air-slide 73 with a bubble 71 and "rat-hole" 72 which are formed with fluidization of many fine and cohesive powders. Uneven depth of powder is shown as 74 and 77. One aspect of the invention described herein is to decrease the amount of powder remaining in a bulk storage silo after transfer by permitting a lower height of the mound of remaining powder. Such greater efficiency in transferring powder is economically beneficial.

When the gas (air) is turned back on, the air flow takes the path of least resistance and avoids the heavily loaded diffuser section, which now is incapable of fluidizing until the vessel is partially refilled to equalize the gas flow resistance along the length of the bed. While not always practical, refilling will ensure a more uniform loading along the air-slide and hence more uniform resistance to gas flows.

One approach to a solution, described in U.S. Pat. No. 4,118,074, incorporated by reference herein, cycles the fluidizing air supply between two adjacent fluidized beds. In doing so, this technique provides a sub-sonic frequency pulsation that alternates from one bed to the other. This system is capable of being improved to cycle more efficiently so as to apply a pulsation energy comparable to the pumping energy of the compressed air supply, which is at least one order of magnitude greater than vibrating energy levels supplied from any of the other techniques described here earlier. There are however, several deficiencies with this patent, which substantially limits its utility. First, the device as described in the patent does not allow for the efficient cycling of the air pressure and results in poor energy transfer of the pulsing effect; second, the system requires two and only two beds to be supplied from each air supply; and third, it is designed to operate at a predetermined, fixed frequency, the effect of which only is capable of breaking-up lumps that may impair the initiation of the fluidizing effect. This patent fails to address a means of avoiding development of gas channeling that forms after several minutes (typically 2 to 10 minutes) of operating a fluidized bed at a constant pulse frequency. Ultimately, this channeling disrupts the effectiveness or causes the cessation of the uniform fluidized conveyance of fine materials, and especially finely divided cohesive powders including Class C Fly Ash and some types of cement. Furthermore, even while the bed may not be totally disrupted by this channeling, the considerable gains in mass flow of a pulsed bed rapidly deteriorate over the same time period.

There is a need for a method that overcome problems such as particulate stickiness and channeling in a fluidized bed system over a sustained period of time. Further, there is a need to lower energy use in maintaining a fluidized bed system and in transferring particulate material.

In one aspect of this invention, particle dynamics of a fluidized bed is modified to minimize the condition under which channeling can be created or sustained and lowers energy use.

In another aspect of this invention, the tendency of powders to stick together during sustained operation of a fluidized bed is minimized.

In another aspect of this invention, an apparatus is used to modify the fluid dynamics of a fluidized bed by using a variable frequency energy pulse to the fluid bed gas flow.

These and other aspects of this invention are described herein.

SUMMARY OF THE INVENTION

This invention is a method for operating fluidized beds, such as used to convey powdered material, wherein fluidizing gas flows are pulsed or vibrated to help initiate and maintain fluidization. The invention maintains the fluidization effects by preventing channeling or 'rat-holing' in a powder bed by oscillating gas pulse frequencies in the 0.5 to 300 hertz range. The invention further is directed to efficient conversion of the energy contained in the pressurized gas flow to vibrational energy. The invention describes devices capable of feeding one or more fluidized-beds from a compressed (pressurized) gas supply, thus conserving energy and increasing mass transfer within the beds.

BRIEF DESCRIPTION OF THE DRAWINGS

FIG. 1 shows a portion of fluidized bed chamber fed by multiple gas input ports connected to a rotating cylinder valve supplying gas to the chamber at separate "air-slide"locations, which are out of phase with one another.

FIG. 2 shows a cross-section of the cylinder valve shown in FIG. 1.

DETAILED DESCRIPTION

Figure 3:
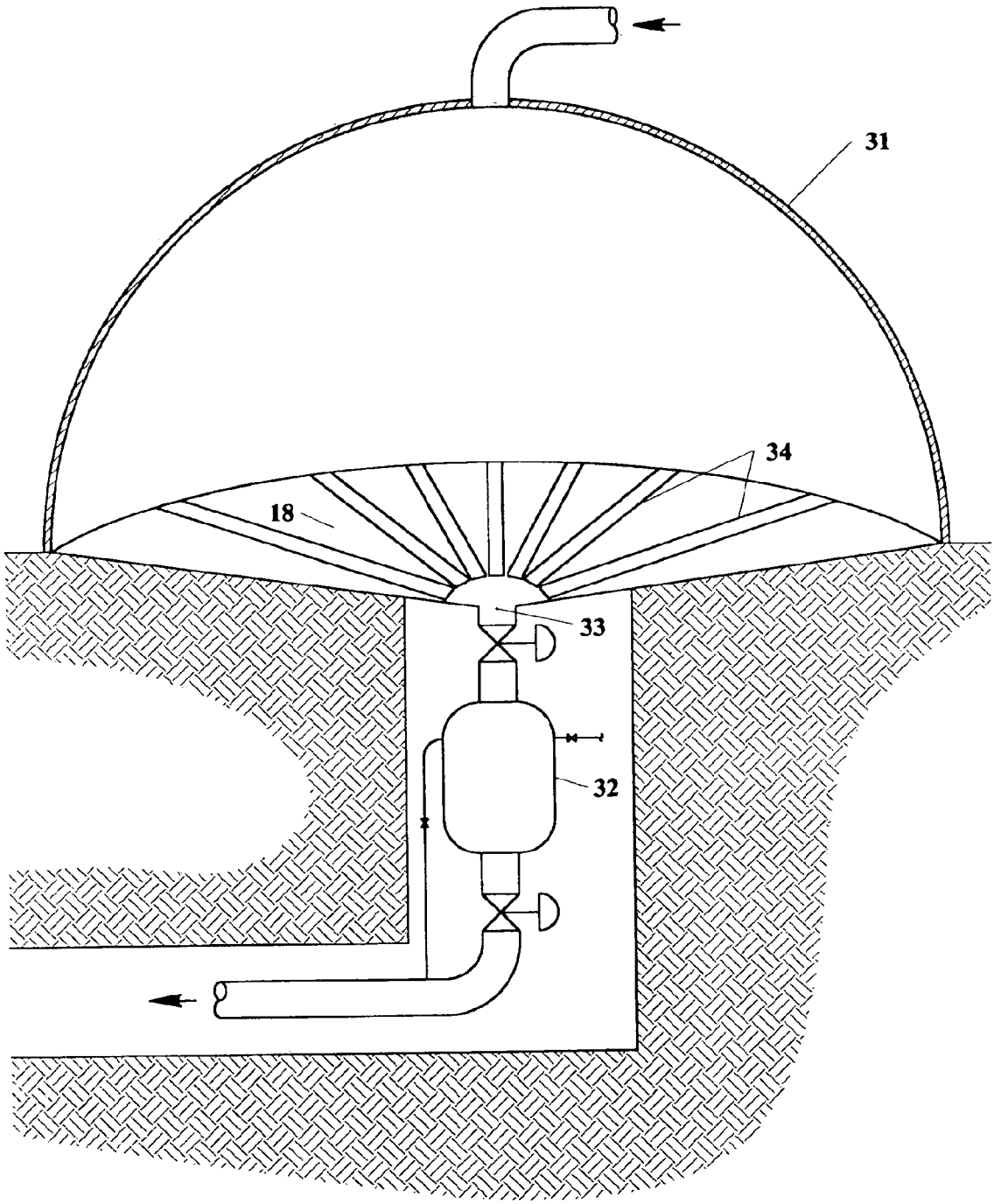
FIG. 3 shows a cross-section of a large powder storage dome with a depressed conical floor lined with multiple air slides radiating from a central solids discharge port, through which powder is transferred to a pressure pod located underneath the dome and then from the dome as dense phase powder.

The present invention relates to use of multiple frequencies of vibrating gas (such as air) as a beneficial means for sustaining an improved discharge of powdered materials from gas medium conveyors such as fluidized beds. More specifically, the invention relates to using the energy already contained in a pressurized gas supply to generate a vibrating or pulsating gas flow energy, by providing a mechanical means of chopping the flow or otherwise mechanically switching the flow rapidly. Furthermore, this invention describes a method of constantly varying or cycling the pulse frequency to prevent the formation of channeling effects and rat holes that form when using a constant frequency.

The present invention supplies a vibrating gas to the fluidizing device, which in the case of a fluidized-bed, effectively provides the means to distribute high vibrating energy levels over the entire bed area. The particles, if held together with light cohesive forces, will be shaken apart by the motive force provided by the vibrating pneumatic energy. This effect improves the ease by which gases can permeate upwards into the particle bed, and collapses local particle bridging effects and channeling. When this is achieved using a constant pulse frequency, it is believed that resonating wave or wave interference effects cause certain regions of the bed to become more active than others, and while this may not be the only cause, the observed effect shows preferential gas flows develop in some regions of the bed and that leads to channeling and rat holes. Changing the pulsation frequency of a gas flow, preferably every 2 to 10 minutes, prevents the loss of mass flows caused by single frequency channeling, presumably by effectively re-positioning any resonating zones capable of forming channel flow. After a similar time, the frequency is changed again, which may include the starting frequency. A constantly changing frequency also will achieve the same result as a stepwise change between two or more frequencies.

This invention describes pulsating the gas supply in a fluidized bed system typically at a frequency of between 0.5 and 300 Hertz. The choice of frequency may depend on the nature of the particles and the vessel or "air-slide" geometry, and while the fluidization of some powders show an improvement as frequency increases, the great majority of the benefits are demonstrated at frequencies below 50 Hertz and no significant further improvement may be seen by using frequencies greater than 200 Hertz for typical powders. Typically, very low frequencies (e.g. less than 15 hertz) have more effect on macro structures within the bed such as bridging; whereas higher frequencies, such as 40 hertz, induce micro effects of shaking the particles and un-sticking cohesive particles, although both effects are observed to varying degrees throughout the frequency range. During development of this invention, it has been observed that the frequencies need not extend outside the sub-sonic range of the human ear, which is an operator benefit when using high energy levels. The pulsation can be a single variable frequency, or an oscillating frequency, and may include the use of several frequencies simultaneously, or any combination of these methods, to achieve both macro and micro effects described.

Figure 4:
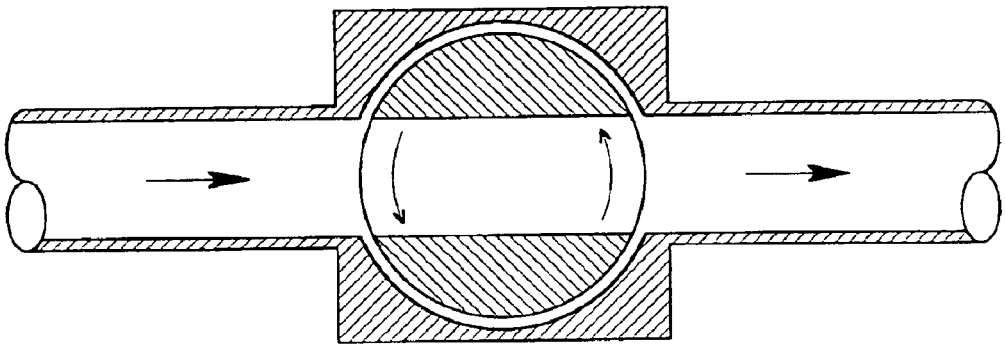
FIG. 4 shows a ball-valve gas chopping device which can be rotated to produce a pulsating compressed gas feed to a single fluidized-bed.
Figure 5:
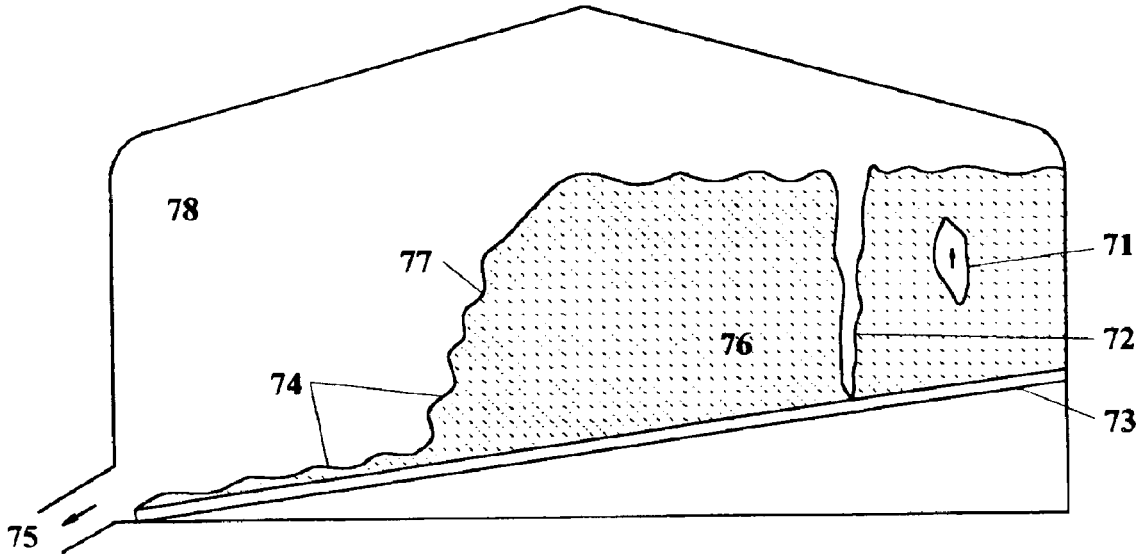
FIG. 5 shows a bulk storage shed with an inclined fluidized floor leading to an exit with a depiction of an unevenly loaded air-slide with a bubble and "rat-hole"which are formed with fluidization of many fine and cohesive powders.

The frequency of the gas pulsation can be induced by a variety of techniques familiar to those skilled in the art. These techniques may include any method that induces pulsations indirectly from reciprocating surfaces or pumps or momentarily restricting the passage of the gas flow, and may include oscillating (or rotating) veins, cams, valves, diaphragms or gates. The simplest preferred method is a single bore plug or ball valve (such as illustrated in FIG. 4) rotating at between 120 and 1,200 RPM (i.e. 4 to 40 Hz) or a set of these used in parallel and/or in series. This configuration not only produces a faster rise and fall of the energy pulse, it can easily be used to supply a single bed, which is an option that was not possible using the aforementioned U.S. Pat. No. 4,118,074.

An example of a device useful in an operation of one or more fluidized bed systems contained in one or more enclosures, having pressurized gas flowing to the fluidized beds, is a flow-switching mechanism providing pressurized gas with pulsating energy flow, the mechanism capable of oscillating the pressure or amount of gas flowing to the fluidized beds with a variable pulsating frequency in the range of about 0.5 to 300 hertz.

The preferable apparatus for use in this new invention uses a rotating cylinder valve with one or more slots or holes to distribute the gas flow fed down through its hollow axis and is illustrated in FIG. 1. As illustrated, a gas valve body 15 fitted with a rotating gas conduit member 14 distributes gas flow at normal fluidization velocity through conduits 16 to fluid bed chamber gas inlets 12 to fluidize a bed of particulate material 13 and 18. In operation, rotation of member 14 causes pulses of gas flow through conduits 16 to create fluidization condition in the particulate matter bed. A suitable gas valve or distribution device is capable of creating gas flow pulsation means in sufficient velocity and volume to maintain fluidization conditions.

In operation, preferably, each gas outlet receives a pneumatic pulse that is 'out of phase' with the pulses to adjacent outlets, although a useful system may be operated without such 'out of phase' pulses. These 'out of phase' pulses can be used to feed different air-slide conveyors, which may be in proximity or parallel to each other. This 'out of phase' vibration provides a shear force to any material 18 lying between the fluidized surfaces and aids in collapsing these unstable accumulations or piles. This technique is of particular use when dealing with powders with a high "angle of repose" such as Class "C" Fly Ash.

FIG. 2 illustrates in cross section of one embodiment of a cylinder valve of this invention shown in FIG. 1 in which four gas inlets are fed by four gas outlets in the cylinder valve. Pressurized gas inlet rotating conduit 14 has two slots which are positioned around cylindrical conduit 14 such that preferably only one slot 17 is in gas communication with an opening 11 at a time. The illustrated arrangement of two slots 17 in FIG. 1 during operation will create an out of phase pulse of gas to the fluidized bed chamber. Altering the location of slots 17 around conduit member 14 or the outlet holes 11 around the valve body wall 10 will modify the gas pulse pattern to the fluidized bed chamber.

In more detail, a suitable and preferable gas distribution apparatus useful in this invention shown in FIG. 2 comprises a cylindrical valve body 15 having a wall 10 with gas outlet openings 11 in fluid communication with conduits 16 and fluidized bed gas inlets 12 and a hollow rotating cylindrical gas conduit member 14 positioned and chambered in gas tight seal within valve body 15 with one or more slots 17 which are aligned intermittingly with wall openings 11 during rotation of member 14 to permit pulsed distribution of gas through inlets 12 to the fluidized bed. In typical operation, pressurized gas flow into the gas conduit member and, during rotation of such member, such gas is distributed to the fluidized bed through the gas outlet openings as pulses. The frequency of the pulses is determined by the rotation rate of the gas conduit member. The phase of the pulses through the gas inlets is determined by the alignment of the slots in the gas conduit member and the gas outlet openings in the valve body. In typical operation, the valve body and the gas conduit member are suitable for the amount of gas pressure used in the system.

According to this invention the rotation rate of cylindrical conduit 14 varies to create a changing gas pulse frequency during operation. Such rotation rate cylindrical conduit is maintained by suitable devices such as electrical or pneumatic devices and typically controlled by controllers known in the art (not illustrated).

To minimize flow disruption of the feed gas (and hence minimize pressure build up on the gas supply side), the number, size and shape of the gas distribution slots can be optimized with the number of outlets required (i.e. the number of fluidized beds being supplied). Changing the shape of the slot in the cylindrical valve and the shape of the valve's inlet and outlet can also offer advantages, because a rotating rectangular slot entering a rectangular shaped valve inlet will produce more abrupt pressure rise and can be used to induce more of a square-wave air pulse than a sine wave pulsation. While a square wave oscillation is not essential for the benefits claimed herein, a squared wave pulse will retain more of its oscillating energy level over a greater length of pipe work and ducting.

An advantage of this invention is that once fluidization of fine powders is achieved the flow rates of gas required can be reduced while still maintaining fluidized flow in the vicinity of the diffuser. This is because fine powders require a finite period to de-gas, and once aerated, the powders may remain fluid without additional gas for some seconds. This reduced compressed gas flow results in energy savings, which prototype testing suggests is in the order of 50% when 'on-pulse'is equal in period to the 'off-pulse'. This conservation of compressed (pressurized) gas increases to 70% as the 'off-pulse' period is increased to 75% of the cycle time, showing that increasing the 'off-pulse' period allows four or more fluidized beds to be held active without significantly increasing total gas flows above that required by one bed using continuous flow at the 'normal fluidizing velocity'. The ability to fluidize powders with progressively shorter pulses is considered to be roughly proportional to the de-gassing time of the powder being fluidized.

Further reductions in the use of pressurized gas, and hence savings in energy, are obtained when using the process of this invention to fluidize powders characterized by having long de-gassing periods or high cohesive characteristics, such as corn flour, cement powder or Class C Fly Ash. Using a 50% 'on pulses' has achieved a fluidization mass flow performance of a bed of powder with an 80% reduction in air flow compared to that achieved using continuous air flows. Using 'on pulses' shorter than 50% may further decrease the energy required to fluidize powders of this type.

This invention is a method for the operation of fluidized beds that use a fluidizing gas in a non-continuous flow, so as to induce a vibration, referred to as a pulsating energy level or pulsating flow, in the gas flowing to the fluidized beds in which the majority of the pulsating energy is derived from mechanically chopping or otherwise oscillating the flow rate of the pressurized gas flowing to one or more fluidized beds, and in which the pulsating energy frequency is changed between multiple frequencies in the range of 0.5 to 300 hertz, and such frequency changes could include stepwise, cyclically, random or continuous or as appropriate.

The pulsating effect is derived by installing a device to modify the amount of gas flowing to and or from the fluidized bed, and such a device may include a flow damper, diverter, valve, or other flow switching mechanism capable of oscillating the pressure or the amount of gas flowing to a fluidized bed. Alternatively, the pulsating effect may be created by means of compressing the gas to induce a pulsating effect such as using an oscillating surface, which may include devices such as a oscillating diaphragm or piston.

In operation of a fluidized bed a using this invention, the average gas flow rate can be reduced by as much as 80% of the flow normally required to maintain fluidization under constant gas flow condition. Thus, the supply of compressed or pressurized gas is conserved, resulting in the bed of fluidized particles containing less gas, which enables greater bulk-density flows to be conveyed within and discharged from the container housing the fluidized bed.

Also, in operation of a fluidized bed using this invention, the shape of the pressure wave generated can be in the general form of a sine-wave, but may also include of rectangular, trapezoidal, or triangular shaped wave forms; alterations to the ratio of the period of the 'on pulse' to the 'off pulse'; and the use of multiple wave forms and frequencies delivered either simultaneously or sequentially.

In the method of this invention, the pulsating energy levels reflected upstream into the source of pressurized gas may be minimized by switching a single flow of pressurized gas between multiple fluidized beds, wherein such method can be further optimized by changing the relative shape and size of the inlet and outlet ports used in the flow switching device.

Also in the method for the operation of fluidized beds according to this invention, pneumatic shear may be induced in volumes of powder lying between multiple fluidized beds to destabilize multi-particle structures by supplying these beds with pulsating energy flows wherein the frequencies used in these different beds are partially or completely out of phase with one another.

A further advantage of in using lower total gas flows, is that the fluidized powder has less gas entrained and more powder per unit volume, which allows a greater mass of powder to flow into discharge pods (32 in FIG. 3) used for dense-phase transfer, and commercial size testing has shown a dramatic increase in powder discharge rates from 60 minutes per 20 tons to 35 minutes per 20 tons when using this invention set at a 50% 'on-pulse' at pulse frequencies cycling between 15 and 37 hertz.

Numerous variations and modifications can be made without departing from the spirit of the present invention. Therefore, it should be clearly understood that the form of the present invention described above and shown in the figures of the accompanying drawings is illustrative only and not intended to limit the scope of the present invention.

What is claimed is:

1. A method of optimizing discharge of at least one fluidized bed of particles from an enclosure comprising a porous surface into a gaseous medium conveyor comprising:

providing a pulsation means separate from said enclosure and in fluid communication with said porous surface;

using said pulsation means to induce a pulsating flow of gas through said porous surface to agitate said bed and thereby discharge said particles;

minimizing uneven distribution of gas flow in said bed comprising rat hole formation and channeling by changing the frequency of the pulsations among multiple frequencies in a range of about 0.5 to 300 hertz;

said minimizing of uneven distribution of gas flow optimizing particle conveyance.

2. The method of claim 1, wherein a majority of the pulsating pressurized gas flow is created by mechanically chopping a stream of pressurized gas.

3. The method of claim 1 wherein the pulsating frequency changes comprise stepwise, cyclical, random, or continuous changes.

4. The method of claim 1, wherein the pulsation means is provided by a device to modify the amount of gas flowing to and/or from the fluidized bed, the device comprising a flow-switching mechanism capable of oscillating the pressure or the amount of gas flowing to a fluidized bed.

5. The method of claim 4 wherein the flow-switching mechanism comprises a flow damper, diverter, or valve.

6. The method of claim 1 wherein the pulsating flow is provided by compressing gas to induce a pulsating effect using an oscillating surface.

7. The method of claim 6 wherein the compressing step is enabled using an oscillating diaphragm or piston.

8. The method of claim 1 wherein the shape of the pressure wave generated by the pulsating flow comprises rectangular, triangular or sinusoidal wave shapes.

9. The method of claim 1, wherein the pressure wave generated by the pulsating flow comprises altering the ratio of the period of an 'on pulse' to the 'off pulse'.

10. The method of claim 1 wherein the pressure wave generated by the pulsating flow uses multiple wave forms and frequencies delivered either simultaneously or sequentially.

11. In combination with an operation having at least one enclosure comprising a porous surface and housing one or more fluidized beds of particles and in fluid communication with a gaseous medium conveyor, a device separate from said enclosure which optimizes discharge of said particles into said gaseous medium conveyor comprising a flow-switching mechanism which provides a pulsating flow of gas through said porous surface to agitate said bed and thereby discharge said particles; said mechanism changing the pressure or amount of flowing gas among multiple frequencies in a range of about 0.5 to 300 hertz for minimizing uneven distribution of gas flow in said one or more beds comprising rat hole formation and channeling, thereby optimizing particle conveyance.

12. The method of claim 4 further comprising a step of minimizing the pulsating flow reflected back to an upstream source of pressurized gas by using said flow-switching mechanism in combination with multiple enclosures and/or multiple fluidized beds within the same enclosure.

13. The method of claim 4 further comprising a step of minimizing the pulsating flow reflected back to an upstream source of pressurized gas by changing the number, and/or the relative shape and size of inlet and outlet ports of the flow-switching mechanism.

14. The method of claim 4 further comprising a step of generating multiple frequencies to the pulsating gas flow by changing the number, and or relative shape and size of inlet and outlet ports of the flow-switching mechanism.

15. The device of claim 11 wherein the flow-switching mechanism comprises a flow damper, diverter, or valve.

16. The device of claim 11 further comprising an oscillating surface used to compress the gas to induce the pulsating effect.

17. The device of claim 11 wherein the oscillating surface is creating using an oscillating diaphragm or piston.

18. The device of claim 11 comprising a cylindrical valve body having a wall with gas outlet openings in fluid communication with conduits to gas inlets of a fluidized bed and a hollow rotating cylindrical gas conduit member positioned and chambered in gas tight seal within the valve body with one or more slots which are aligned intermittingly with wall openings during rotation of the member to permit pulsed distribution of gas through inlets to the fluidized bed.

19. The device of claim 18 in which the slots are aligned to produce an out of phase gas pulse during rotation of the member.

20. The method of claim 1 in which a fluidized bed is operated to facilitate conveyance of cement, flour, or fly ash from a bulk storage structure to another location.

21. The method of claim 20 in which the fly ash is Class C Fly Ash.

22. The method of claim 1 wherein the pulsating means generates two or more out of phase pressure-wave gas flows and the said out of phase gas flows are communicated to adjacent fluidized bed in the same enclosure, whereby any unfluidized material laying between the adjacent beds will be subject to an oscillating out of phase pressure to induce fluidization of otherwise stagnated material and thus minimize materials hold up in the enclosure, thereby increasing total discharge.

* * * * *